United States Patent [19]

Eertink et al.

[11] Patent Number: 4,478,405

[45] Date of Patent: Oct. 23, 1984

[54] POSITION CONTROL FOR RECYCLED ORIGINALS IN A COPYING APPARATUS

[75] Inventors: Bastiaan B. B. Eertink, Grubbenvorst; Arie Leppink, Venlo, both of Netherlands

[73] Assignee: Océ-Nederland B.V., Venlo, Netherlands

[21] Appl. No.: 400,090

[22] Filed: Jul. 20, 1982

[30] Foreign Application Priority Data

Jul. 21, 1981 [NL] Netherlands ..... 8103440

[51] Int. Cl.[3] ..... B65H 7/10

[52] U.S. Cl. ..... 271/227; 271/250; 355/145 H

[58] Field of Search ..... 271/227, 228, 3.1, 4, 271/301, 261, 250, 251; 355/3.5 H, 145 H

[56] References Cited

U.S. PATENT DOCUMENTS

| | | | |
|---|---|---|---|
| 3,947,016 | 3/1976 | Horung | 271/12 |
| 4,058,359 | 11/1977 | Urselmann | 355/109 |
| 4,245,836 | 1/1981 | Joosten | 271/228 |
| 4,371,159 | 2/1983 | Doyen | 271/228 |

FOREIGN PATENT DOCUMENTS

| | | |
|---|---|---|
| 0029969 | 6/1981 | European Pat. Off. . |
| 2422130 | 2/1973 | Fed. Rep. of Germany . |
| 1307664 | 2/1973 | United Kingdom . |

*Primary Examiner*—Bruce H. Stoner, Jr.

*Assistant Examiner*—John A. Carroll

*Attorney, Agent, or Firm*—Albert C. Johnston; Louis H. Reens

[57] ABSTRACT

A position control system in a copying apparatus keeps an original positioned properly during multiple passes of the original through a transport path, for making multiple copies, by detecting the position of an edge of the original in the first pass, when the original is fed into the apparatus; setting a reference condition corresponding to the then existent side edge position; and in each subsequent pass of the original detecting its position and in the event of a deviation of the detected position from the position represented by the reference condition activating a position correcting device to displace the original to the latter position. In one embodiment, at least one detector to sense the location of a side edge of an original is reciprocated across the path of that edge during the first pass and, upon sensing the side edge, is stopped at a location corresponding to the position of the original; after which, in each ensuing pass of the original, the detector will issue a correcting signal if the position of the original differs from that for which the detector is positioned. In another embodiment, detectors arranged in a row across the path of a side edge of the original produce output signals which on the first pass of the original are stored in a memory, and on each subsequent pass of the original are compared with the memory condition, with resultant issuance of a correcting signal if the original is not in the desired position.

8 Claims, 5 Drawing Figures

POSITION CONTROL FOR RECYCLED ORIGINALS IN A COPYING APPARATUS

This invention relates to a control system by which a misregistration of an original being duplicated in a copying apparatus can be detected and corrected so that the original will be kept positioned correctly when passed repeatedly into a copying path of the apparatus.

BACKGROUND

A positioning system for an original passed one or more times through a copying path of a copying apparatus is disclosed in U.S. Pat. No. 4,058,359. In that system, use is made of photodetectors on both sides of a desired line of transport of a side edge of an original. If a detector at the inner side of the transport line is not illuminated while a detector at the outer side of the line is illuminated, then the side edge of the original is deemed to be located within a tolerance range relative to the desired transport line. During a repeated transport of the original through the copying path for the production of several copies from the same original, however, it can happen that the original gradually deviates from the desired transport line, displacing slowly to the left or right of the line. As a result, instances can arise in which the side edge of the original is displaced so far in one direction that the original is moved beyond the range of the inner detector that originally was not illuminated. It also can occur in some circumstances that the original becomes displaced so far in the other direction that both detectors are covered by the original and thus neither detector is illuminated.

In both types of displacement of the original a position correction means is operated in such a way that the side edge of the original is brought back within the tolerance range relative to the desired transport line.

A suitable position correction means, as shown in U.S. Pat. No. 4,058,359, includes a roller over which the original is transported and which is journalled at both ends in such a way that the roller can be displaced axially. A lever is employed which engages in a recess of the roller, and by which the roller can be moved over a predetermined distance in the axial direction, either to the left or to the right. Friction elements on the roller increase the grip exerted by the roller on the original. During the transport of the original over the roller, and preferably immediately after the leading edge of the original has passed the roller, the roller can be moved by the lever to the left or to the right. This motion causes the original to be displaced a predetermined distance either to the left or to the right to correct a deviation of the original from the desired transport line.

As described in the cited patent, the original is fed in along a lateral guide beyond which the side edge of the original is to be detected. The detectors in the position detector are so positioned that when the original has been fed in with a side edge at the lateral guide, the side edge then passes between the detectors and is deemed to be within the tolerance range of the ideal transport route. It will be obvious that if in the embodiment of the U.S. Pat. No. 4,058,359 the lateral guide is displaced laterally, the detectors must be correspondingly displaced. Such displacement of the lateral guide may be desired, for example, when an edge of the original is provided with a suspension strip or other marginal strip that is not to be copied. In such a case, the lateral guide needs to be displaceable so that the suspension strip or marginal strip will lie just outside the surface to be copied; but when that is the case the detectors need to be mechanically linked to the lateral guide, thus introducing problems.

GENERAL DESCRIPTION

It is, therefore, an object of the present invention to provide an improved position control system for an apparatus of the type described by which an original to be transported any number of times through a copying path can be kept reliably in a desired position for each pass of the original sheet into the copying path, and can be so positioned whether or not an edge of the original carries a marginal strip that is not to be copied, and without need for lateral adjustments of an edge guide when such a guide is present to align an original being fed into the apparatus.

This object is achieved according to the invention by the provision of a position control system which makes use of the position of an edge of an original as detected during the first pass of the original for being copied as a reference or control condition for the determination, and as the base for any needed correction, of the position of the original when it is recycled for one or more further passes to produce multiple copies.

The invention is suitable for a copying apparatus of any of the various forms which are capable of producing multiple copies of an original fed into a transport path and include transport means for passing the original through that path into a copying path, in which for instance the original may be illuminated for making a copy, and means operable when more than one copy is to be made for returning the original to the transport path for another pass into the copying path. A position control system for such a copying apparatus as previously disclosed in the above-mentioned patent includes detecting means for sensing positions of the original in the transport path and correction means for displacing the original to a desired position in the transport path when the original is sensed to be away from that position. According to the present invention, the position control system further comprises a position reference means which, during a first pass of an original through the transport path, is settable to a certain control condition representing the then existent position of the original, together with a control means operable during a subsequent pass of the original through the transport path for controlling the correction means by coaction of the position reference means and the detecting means.

In a particularly advantageous embodiment of the invention, the detecting means comprises at least one detector for sensing locations of a side edge of an original in the transport path, together with means for displacing a detector in a direction transverse to the direction of travel of the side edge and means operable during the first pass of an original to activate the displacing means and cause it to position and then hold the detector at a certain location thereof corresponding to the then existent location of the side edge.

The detector itself may cause the displacing means to stop its motion by issuing a signal at the moment when it first senses the side edge during the first pass of the original. According to a further advantageous feature of such an embodiment, the detecting means can comprise several detectors which are displaceable transversely relative to the path or paths of the side edge and each of which is selectable for sensing a particular range of locations of the side edge of the original.

According to another embodiment of the invention, the detecting means comprises a plurality of detectors arranged in a row transverse to the path or paths of movement of a side edge of an original in the transport path, each of these detectors being operable to sense the presence or absence of an original at its location and to issue a corresponding detector signal, and the position reference means comprises a memory to store a control condition corresponding to the state of the detector signals that existed during the first pass of an original, together with a comparator operative during each subsequent pass of the original to compare the then state of the detector signals with the state thereof represented by the control condition, or stored signals, of the memory. The comparator then can respond to certain relationships of the signal states so as to issue a control signal for activating the position correction means, thus displacing to the desired position an original sensed by the detectors as having crept away from that position.

The row of detectors in such embodiment of the invention can be of such length that the side edge of an original being fed into the copier along a lateral guide will cross the row at all positions of adjustment of the lateral guide. Thus the detectors of the row will always be divided into a subgroup which is covered by the original, so is not illuminated, and another subgroup of detectors that are not covered by the original, so are illuminated. The point of transition between these subgroups corresponds to the location of the detected side edge of the original.

According to a further feature of an embodiment of the invention employing a row of detectors across the transport path of an original, means are provided for presenting the respective detector signals as digits which together constitute a binary number. The comparator compares the number formed by the detector signals during the first pass of the original, which number is stored in a memory, with the number formed by the detector signals during a subsequent pass of the originals, and issues an output signal the value of which depends on whether one of the two numbers is greater, less than, or equal to the other.

In case of need to copy an original having a protrusion on its side edge, such, for example, as a perforated suspension strip, it can occur that one of the detectors of the subgroup that is not to be illuminated because covered by the original is nevertheless illuminated for a brief period. This could lead to incorrect interpretations of the binary number combination formed from the detector signals and thus to issuance of an incorrect control signal to the position correction means. To prevent this, according to a further feature of the invention, an OR gate is provided for each detector in a row of detectors; each detector is connected to a first input of the related OR gate; and the output of the OR gate related to each detector, except the OR gate related to one of the two endmost detectors of the row, is connected to the second input of the OR gate related to the next adjacent detector of the row.

Such an arrangement ensures that the most significant digit "1" formed by a detector signal is transmitted via the related OR gate in the direction of the less significant "0" bits. Thus, a correction is made for a digit "0" that might appear incorrectly between ones in a row of digits forming the binary number combination.

Further objects, features and advantages of the invention will be apparent from the following description of illustrative embodiments of the invention, in which reference is made to the accompanying drawings. In the drawings:

DETAILED DESCRIPTION

Figure 1:
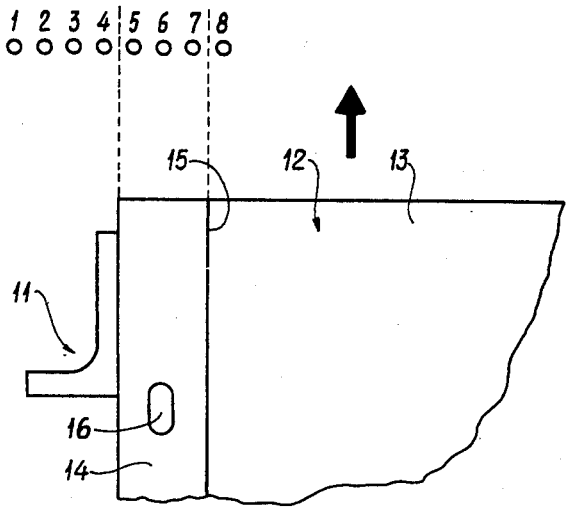
FIG. 1 is a schematic plan view of an original being transported past a lateral guide towards a row of detectors.

FIG. 1 shows an original 12 being transported in the direction of the arrow toward a row of photodetectors 1–8. The left side edge of the original 12 is placed against and guided along a lateral guide 11. The lateral guide 11 and the detectors 1–8 may, for instance, be arranged relative to a feed table and a transport path for an original substantially as are a lateral guide and side edge detectors in U.S. Pat. No. 4,058,359, the disclosure of which is incorporated herein by reference.

The original 12 as illustrated in FIG. 1 comprises a main sheet 13 carrying the image actually to be copied and a suspension strip 14 which is attached to the left edge of sheet 13. In the case of an original having no suspension strip i.e. an image carrier that is to be copied in its entirety, the left edge of the original needs to be located so that it will pass between the photodetectors 7 and 8, as indicated schematically at line 15 in FIG. 1, in order for the image formed from the original to be transferred with correct registration to a copying paper. Correspondingly, in order to obtain the image at the correct location on the copying paper in the illustrated case of an original 12 having a suspension strip 14 to be introduced into the copying apparatus, the lateral guide 11 is positioned to the left so that the separation line 15 between the image section 13 and suspension strip 14 similarly passes along the imaginary line between photodetectors 7 and 8. Thus, as illustrated in FIG. 1, the left side edge of the original 12 now lies on a line that passes between the photodetectors 4 and 5.

The photodetectors 1–8 can be, for example, photosensitive semiconductor elements, such as photosensitive transistors or diodes, that are illuminated by a suitable light source. There can be a single light source for illuminating all the photosensitive elements or separate light sources, one for each photodetector. Separate combinations of light-emitting diodes and photosensitive transistors are preferred for use in carrying out the invention, although other types of detectors can also be employed.

During transport of the original 12 over the row of photodetectors 1–8, with the original passing between the respective photosensitive elements and the associated light source or sources, a number of the photosensitive detectors will be covered by the original. In the arrangement illustrated in FIG. 1, at least in the first pass of the original 12 through the transport path of the copies, photodetectors 5, 6, 7 and 8 will be covered, so not illuminated, during movement of the original 12 past the row of detectors, while photodetectors 1, 2, 3 and 4 will remain illuminated.

Each of the photodetectors is incorporated in a circuit which, when the related photosensitive element is illuminated, gives off at its output a binary "0" and, when the related photosensitive element is not illuminated, gives off a binary "1" at its output. Thus, in the arrangement illustrated in FIG. 1, a series of output signals will be supplied during passage of the original 12 past the row of photodetectors 1–8, which signals together can be interpreted as the binary number combination 00001111.

When several copies are to be produced from the original 12, then, after its first pass through the copying path of the apparatus for the production of the first copy, the original 12 will be returned to the transport path and will again pass over the row of detectors 1–8. If the original 12 has not been displaced laterally in the course of its travel, then again a series of output signals will be generated which represents the number 00001111. If, however, during a first pass or a subsequent pass through the copying apparatus, the original has become displaced toward the right as viewed in FIG. 1, then it may occur that the detector 5 as well as detectors 1–4 will remain illuminated during a subsequent pass of the original through the transport path. Thus, the output signal combination 00000111 is formed. It can also occur that the original will be displaced too far toward the left during a travel through the copier, as a result of which the output signal combination 00011111 may be generated. In each case a control signal is to be generated for activating the position correction means of the apparatus so as to move the original to the left or the right, respectively, over a distance such that the left-hand side edge of the original once again is located on the line of travel extending between the detectors 4 and 5.

If the binary number combination formed by the output signals from the detectors for a first pass of the original is represented as $N_1$ and the binary number combination formed by the detector output signals for a subsequent pass is represented as $N_2$, then rules generally apply as follows for an arrangement as shown in FIG. 1:

$N_2 > N_1$: displace original to the right;

$N_2 = N_1$: no displacement of the original;

$N_2 < N_1$: displace original to the left.

As already mentioned, the position correction means described in U.S. Pat. No. 4,058,359 comprises an axially displaceable roller that can be placed in the correct position by means of a lever which in turn is controlled by two solenoids. If neither of the solenoids is energized, the roller rests in a central position. If one of the solenoids is energized, depending on which one the roller is moved from the central position over a predetermined distance to the left or to the right. Such a position correction means has a disadvantage, however, in that two control elements have to be employed. There also can be another disadvantage in its use for a control system according to the present invention, in that, in the possible case of the output signal combination $N_1 = N_2 = 11111111$, then the original can stray toward the left without corrective measures being taken. Similarly, if $N_2 = N_1 = 00000000$, then the original can stray toward the right without corrective measures being taken.

These disadvantages can be at least partially overcome, according to a further feature of the invention by an embodiment in which, for each pass of the original, the position correction means is provided with a signal to displace the original either to the left or to the right. In applying this feature to the arrangement illustrated in FIG. 1, the following general conditions apply:

$N_2 > N_1$: displacement to the right;

$N_2 \leqq N_1$: displacement to the left;

$N_2 = N_1 = 11111111$: displacement to the right.

It results in such an embodiment that no conditions can occur in which the original strays to the left or to the right outside the tolerance range of the desired transport line without the position correction means being activated so as to bring the original back within the tolerance range. A further available advantage is that the lever of the position correction means can be operated by a single solenoid, although the control itself will then have to be adjusted somewhat. For example, if, with a non-energized solenoid, the roller that displaces the original is disposed to the right and with an energized solenoid it is displaced to the left, then in order to displace the original toward the left it is merely necessary to energize the solenoid after a leading part of the original but before the entire original has passed the roller. In such case, in order to displace the original to the right the solenoid is energized before the arrival of the original at a displacement roller and is de-energized after a leading part of the original has passed the roller, thus moving the displacement roller with the original to the right.

Figure 2:
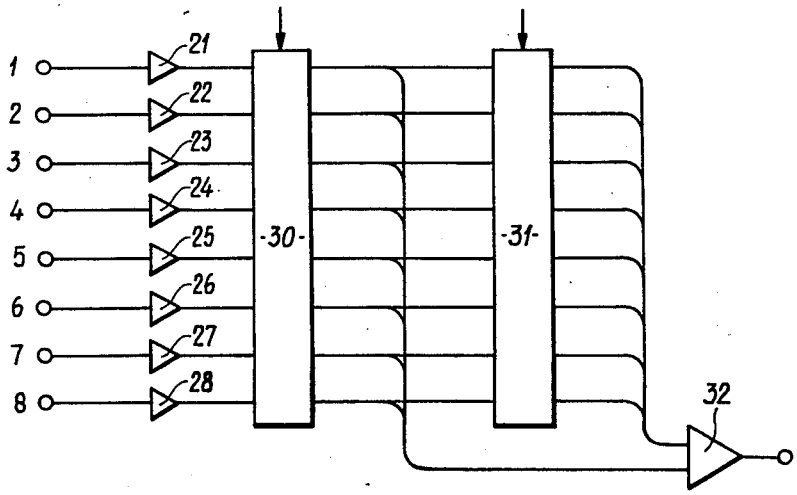
FIG. 2 is a schematic circuit diagram in accordance with one embodiment of the invention, for deriving control signals for a position correction unit.

FIG. 2 schematically illustrates a circuit arrangement for converting output signals from the photodetectors 1–8 into signals for controlling the position correction device. Each of the detectors 1–8 is connected to a related one of eight conversion circuits 21–28. When a detector is illuminated, then the associated conversion circuit provides an output signal at the digital "0" level, and when the detector is not illuminated the related conversion circuit provides an output signal at the digital "1" level. The digital signals at the outputs of the conversion circuits 21–28 are fed to a first register 30 which has corresponding outputs leading into a similar second register 31 that serves as a memory element of the control system. During a pass of original 12 past the row of photodetectors 1–8 a clock pulse is generated in a well known manner and is used to enter the output signals from the conversion circuits 21–28 into the register 30. During a subsequent pass of the original all the contents of the first register 30 are first transferred into register 31, after which the output signals then present at the outputs of conversion circuits 21–28 are entered into register 30.

The digital signal combination present in registers 30 and 31 are regarded as digital numbers and their respective values are compared in a comparator 32. In the preferred system according to this embodiment of the invention, wherein the original is moved either to the right or to the left during each pass over the detectors, the comparator 32 emits an output control signal, for example a digital "0" if the movement is to take place to the right and a digital "1" when the movement is to take place to the left, or conversely. Of course, if use is made of a displacement roller that can be moved both to the left and to the right from a central rest position, then the comparator 32 is adapted to suit this condition.

An original provided with an attached strip 14 often will have a perforation formed in the strip 14, such as the perforation 16 shown in FIG. 1, to serve for suspension of the original. Such a perforation can result, for example, in a binary number combination 00001011 being stored in register 30, instead of the correct number 00001111, due to perforation 16 being located directly above one of the detectors, such as detector 6 in the arrangement illustrated in FIG. 1, and causing this detector to be illuminated during passage of the original past the row of detectors. If at the same moment the output signals from the conversion circuits 21–28 are entered in register 30, then an incorrect number combination is stored in the register and this can give rise to an incorrect determination of the control signal to be issued from comparator 32.

For example, during a first pass of the original the number 00001011 might be detected and stored as a result of the perforation 16 having at least partially allowed light to pass toward detector 6 while detector 7 was still just screened off. Then during a subsequent pass, if the original has shifted slightly to the right but not far enough to illuminate detector 5, the number combination 00001101 may be detected because detector 6 is then just covered and detector 7 is at least partially illuminated. In that case the relationship $N_2 > N_1$ would appear to exist, as sensed by the comparator 32 and in accordance with the general conditions stated above this should result in a displacement of the original to the right. In fact, however, a displacement to the left is required for correction of the position of the original.

Figure 3:
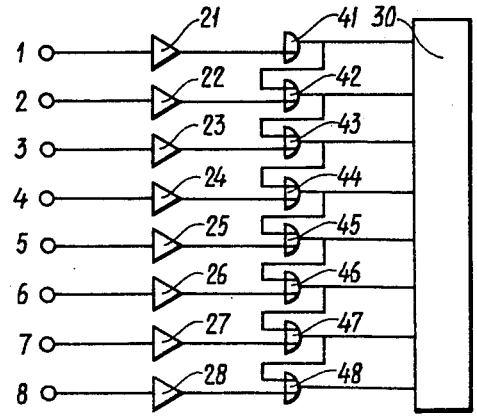
FIG. 3 is a schematic diagram of a modification of the circuit shown in FIG. 2.

To prevent errors of that kind, the control system, as illustrated in FIG. 3, is provided with a combination of OR gates 41–48 between the respective conversion circuits 21–28 and the register 30. The output of each of the conversion circuits 21–28 is connected in the manner shown to one of the inputs of one of the OR gates 41–48. The output of each of the OR gates, except the OR gate connected to circuit 28 of the detector 8, is connected to the second input of the OR gate related to the next adjacent detector so to an OR gate the output of which is less significant in the binary number combination formed at the outputs of the OR gates. It results that the most significant "1" state of any of the OR gate outputs is transmitted to prevent "0" states from occurring at the locations of all the less significant bits, in the digital number combination. Thus, the states of the OR gates in the less significant positions are made equal to "1", regardless of whether, for example, a "0" was at first generated as a result of the presence of a perforation in the strip 14, and instead of an incorrect number such as 00001011 being formed as noted above, the correct number 00001111 is formed and stored in the memory register.

It should be noted that the second input of each OR gate except the OR gate 41, instead of being connected to the output of the OR gate of next higher significance, can be connected as well to the next higher significant output of the register 30. In such case, of course, the control of register 30 must be adapted to suit this situation.

Figure 4:
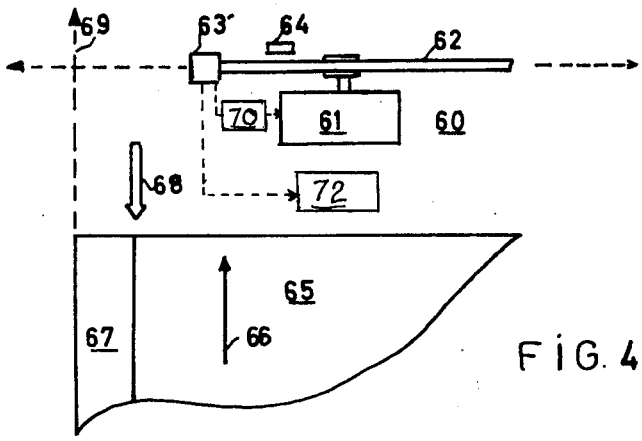
FIG. 4 is a schematic representation of parts of the position control system in accordance with another embodiment of the invention.

In the embodiment of the invention represented schematically in FIG. 4, an original 65 provided with a suspension strip 67 is shown as it is being fed into a copying apparatus in the direction indicated by arrow 66. Arrow 68 is an alignment mark placed on the sheet feed table of the copying apparatus at a location corresponding to the position of the side edge of the copying paper onto which an image of the original is to be produced in the copying apparatus, which paper is located elsewhere in the apparatus. The paper for instance may be in the form of a supply roll from which a strip can be fed through the apparatus in register with the original.

When the leading edge of original 65 passes a first sensor 64, a position detecting means 60 comes into operation. Motor 61 of the position detecting means 60 is then activated and, via a transmission mechanism, drives a rack 62 back and forth in a direction perpendicular to the direction of transport of the original. The velocity of this reciprocating movement is such that at least one complete back and forth movement of rack 62 can be performed in the time required for an original to pass the position detecting means 60, from the leading edge to the trailing edge of the original.

A detector 63 mounted on the end of the rack 62 is activated at the same time as the position detecting means 60. The detector 63 can be, for example, one of a reflection type such as a phototransistor which detects a reflection of light emitted from a lamp, at a specific angle, when an original is conveyed past the phototransistor within a certain distance from it. When the detector 63 being displaced reaches the path 69 and thus the left side edge of the original to be copied, the quantity of light received by the phototransistor changes, and this change, via a control circuit 70, causes motor 61 to stop and thus stops the movement of detector 63. In this way the location of the side edge of the original is determined, and the detector 63 is positioned at a corresponding location, on the first pass of an infed original into the copying apparatus. The position correction means of the apparatus is not activated during such feeding in of the original.

For repeated copying of the same original, after the original has been illuminated, or exposed for making an image, for the first time in the copying path of the apparatus, the original is returned for another pass through the transport path via the position correction means and the position detecting means. When the original thus recirculated has shifted, for instance, to the left relative to the initial feed line at 69, the detector 63 will receive a reflection of light from the original and will emit a signal to the control circuit 72 of the position correction means, thus causing the solenoid that displaces the original to the right to be energized. The solenoid then moves the displacement roller and the original to the right until the left side edge of the original reaches a location just beneath detector 63. At that moment the signal emitted by detector 63 changes and the solenoid is deenergized by the control circuit 72. When the original as returned for a subsequent pass has shifted to the right relative to the initial feed-in line, the detector 63 will not receive any reflection and the other solenoid of the position correction means will be energized by detector 63 to shift the original to the left. This displacement also is continued until the signal from detector 63 changes, whereupon the solenoid is deenergized and the position correction means resumes its inactive condition.

An important advantage of the invention in an embodiment such as that of FIG. 4 is that here too a mechanical link between the detector and a lateral guide for the original being fed into the copier, such as guide 11 in FIG. 1, is not needed for accomodating the copier to originals having strips attached to the side edge that is to be guided into the transport path. This is particularly important for the application of the invention to copiers having a modular type construction of a kind often used for copying apparatus.

Another advantage is provided in that the precision of transport of an original retained in the apparatus for producing multiple copies is higher than that obtained with the known apparatus in which two detectors are situated respectively to the left and to the right of the desired feed line and are separated by a minimum distance of about 5 mm. With a position control system according to the invention a registering precision of 1 mm can be obtained.

Figure 5:
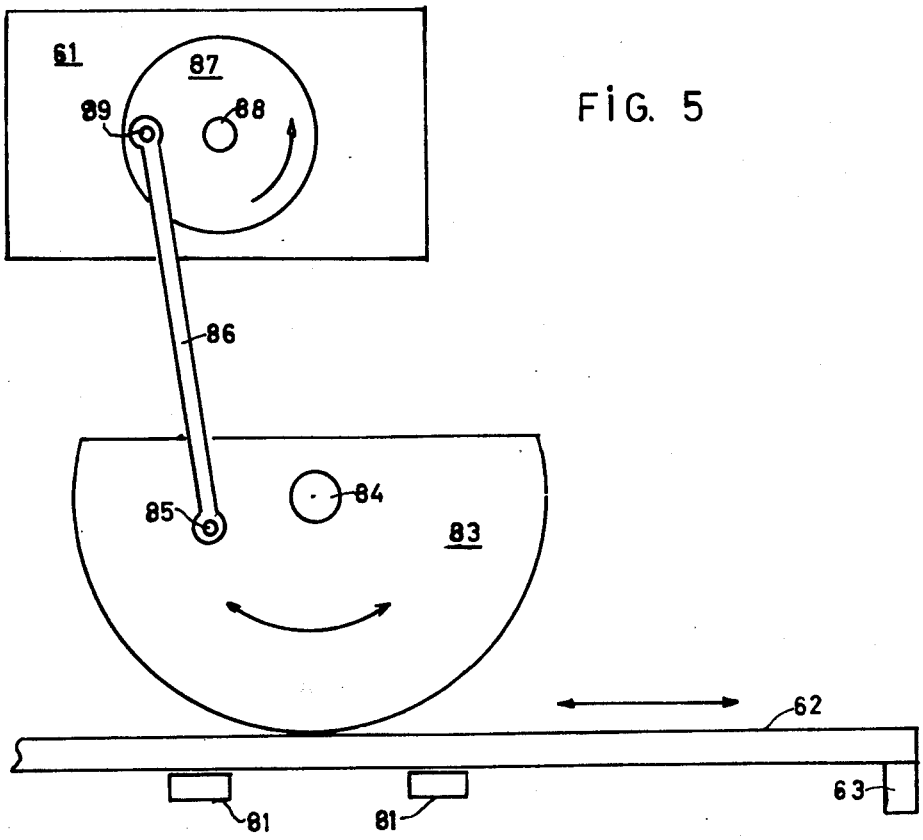
FIG. 5 is a schematic representation of means for the embodiment shown in FIG. 4.

A form of a position detecting means suitable for a position control system such as that of FIG. 4 is shown schematically in FIG. 5. A detector 63 is attached to a reciprocable rack 62 which preferably is toothed and is engaged with a gear wheel 83, also preferably toothed, that is rotatable about a shaft 84. A link 86 has one end thereof pivoted on a pivot pin 85 fixed to the wheel 83, and has its other end pivoted on a pin 89 fixed to a driving wheel 87. Wheel 87 is attached to a spindle 88 of motor 61.

When the motor 61 is started, the driving wheel 87 is rotated in the direction of the arrow and, via link 86, the wheel 83 is rotated alternately clockwise and counterclockwise. As a result, the rack 62 is moved back and forth. By proper selection of the several components of the mechanism and their points of connection, the back and forth movement of the detector 63 can be given any amplitude that is desired for a particular copying apparatus.

Modern copying apparatuses often are provided with several rolls of copying paper having different widths for making copies of different sizes, and with means for selecting the paper to give the desired copy size. For smaller copy sizes preferably the middle part of the copying apparatus is used, which requires that the originals be fed almost in the middle of the apparatus. For such sizes, for instances sizes A1 to A4, the left side edges of the rolls of copying paper are positioned exactly above one another at a location aligned with that of the mark 68 in FIG. 4. When originals of those sizes are being fed into the copier, the mark 68 can be kept illuminated for use to guide the left edge of an original into the copier, and the amplitude of the back and forth movement of rack 62 of the position detecting means can be kept small, for instance at about 10 cm.

When processing large sizes, for instances size Ao, the total width of the copying apparatus must be used and, therefore, the left side edge of the roll of copying paper required for this purpose will not register with that of the other rolls. The amplitude of the back and forth movement of rack 62 of the position detecting means in this case should be much larger, for instance as high as 30 cm. Rather than to employ such a high amplitude of detector movement, a better solution is to provide a second detector on an elongated rack 62 so that this detector is positioned near the left side edge of the large size copying paper.

Thus, each of the detectors is selectable for sensing a certain range of locations of the side edge of an original. The control means employed for selecting the several sizes can also be used to activate the corresponding detector.

The invention is not restricted to the embodiments herein described. For instance, a side edge detector can be moved transverse to the direction of movement of the original in many ways, as by being mounted slidably on a shaft or by being displaceable along a screw spindle. Other variations and modifications of the embodiments described will also be apparent to persons skilled in the art.

I claim:

1. In a position control system for a copying apparatus capable of producing multiple copies of an original fed thereinto and including transport means for passing the original through a transport path into a copying path and means for returning the original to the transport path for another pass into the copying path, said system including detecting means for sensing positions of the original in the transport path and correction means for displacing the original to a desired position in the transport path when the original is sensed to be away from such position, the improvement wherein said system comprises position reference means settable during a first pass of an original through the transport path to a certain control condition representing the then existent position of the original and control means operable during a subsequent pass of the original through the transport path for controlling the correction means by coaction of the position reference means and said detecting means, said detecting means comprising at least one detector for sensing locations of a side edge of an original in the transport path, said position reference means comprising means for displacing said at least one detector in a direction transverse to the direction of travel of said side edge and means operable during a said first pass of an original to activate said displacing means and cause it while the original is travelling to position and then hold a said detector at a certain location thereof corresponding to the then existent location of said side edge.

2. A position control system according to claim 1, said position reference means comprising a reciprocable support member carrying said at least one detector, means operable during a said first pass to reciprocate said support member and thus move a said detector back and forth across the path of said side edge, and means responsive to a said detector at the moment when it first senses said side edge to stop movement of said support member.

3. A position control system according to claim 1 or 2, said position reference means being operative to position and hold a said detector at a location just above the location of said side edge during said first pass.

4. A position control system according to claim 3, said detecting means comprising a plurality of detectors, each selectable for sensing a respective range of locations of a said side edge.

5. A position control system according to claim 4, each of said detectors having a displacement path of its own transverse to said direction of travel so that said detectors can sense respective ranges of locations of side edges of originals having distinctly different widths, and means whereby in accordance with the width of an original fed to be copied a corresponding one of said detectors is selectively activated for controlling said correction means.

6. In a position control system for a copying apparatus capable of producing multiple copies of an original fed thereinto and including transport means for passing the original through a transport path into a copying path and means for returning the original to the transport path for another pass into the copying path, said system including detecting means for sensing positions of the original in the transport path and correction means for displacing the original to a desired position in the transport path when the original is sensed to be away from such position, the improvement wherein said system comprises position reference means settable during a first pass of an original through the transport path to a certain control condition representing the then existent position of the original and control means operable during a subsequent pass of the original through the transport path for controlling the correction means by coaction of the position reference means and said detecting means, said detecting means comprising a plurality of detectors arranged in a row transverse to the possible paths of movement of a side edge of an original in the transport path, each detector being operable to sense the presence or absence of an original at its location and to issue a corresponding detector signal, said position reference means comprising a memory operative to store a control condition corresponding to the state of the detector signals during a said first pass of an original and a comparator operative during each subsequent pass of the original through the transport path to compare the then state of the detector signals with the state thereof represented by said control condition in the memory, said comparator being responsive to certain relationships of said signal states to issue a control signal for activating said correction means.

7. A position control system according to claim 6, and including means to present said detector signals as respective digits which at any moment collectively form a binary number combination, said comparator being operative to compare the binary number combination formed by said digits during each said subsequent pass with the binary number combination formed by said digits during said first pass and thus to determine whether the former number is greater than, less than, or equal to the latter number.

8. A position control system according to claim 6 or 7, said position reference means further including for each of said detectors an OR gate having a first input connected with the related detector and having its output connected with said comparator, each OR gate so related to a detector, except one of the two OR gates related to the endmost detectors of said row, having its second input connected to the output of the OR gate related to the next adjacent detector of said row.

* * * * *